US012402670B1

(12) United States Patent
Saddler

(10) Patent No.: US 12,402,670 B1
(45) Date of Patent: Sep. 2, 2025

(54) ARM-WORN COLLAPSIBLE NURSING COVER AND BLANKET

(71) Applicant: Melissa Saddler, Washington, DC (US)

(72) Inventor: Melissa Saddler, Washington, DC (US)

( * ) Notice: Subject to any disclaimer, the term of this patent is extended or adjusted under 35 U.S.C. 154(b) by 0 days.

(21) Appl. No.: 18/819,251

(22) Filed: Aug. 29, 2024

(51) Int. Cl.
*A41D 1/215* (2018.01)
*A41D 27/24* (2006.01)

(52) U.S. Cl.
CPC ..... *A41D 1/215* (2018.01); *A41D 27/24* (2013.01); *A41D 2400/00* (2013.01)

(58) Field of Classification Search
CPC ..... A41D 1/215; A41D 13/088; F41H 5/08; A45F 2005/1013; A61F 5/0118
See application file for complete search history.

(56) References Cited

U.S. PATENT DOCUMENTS 8,990,968 B2 * 3/2015 Garegnani ..... A41D 1/215 2/104
2017/0164666 A1 * 6/2017 Larnard ..... A41D 1/215
2019/0029340 A1 * 1/2019 Aguilar ..... A41D 13/08
2019/0037939 A1 * 2/2019 Larnard ..... A41D 1/215
2019/0212097 A1 * 7/2019 McDonald ..... A45F 3/06
2020/0188159 A1 * 6/2020 Hatch ..... A61F 5/0102
2022/0295915 A1 * 9/2022 Mearn ..... A41D 27/12

* cited by examiner

*Primary Examiner* — Jillian K Pierorazio

(57) ABSTRACT

The Arm-worn Collapsible Nursing Cover and Blanket is disclosed. The claimed invention is an innovative nursing cover that features a flexible pop-up wire frame that is covered in soft fabric that expands and forms a flexible oval shape that easily collapses into a compact circle for storage. The structured form has arm holes on either side and can be worn on the arm or wrist which offer various configurations and functions for use and create an open barrier that provides complete coverage with an unobstructed view of the baby for the mother. It is designed to enhance the breastfeeding experience by providing full coverage with a full view of their infant while nursing. Additionally, the claimed invention has an affixed magnet that can secure an optional blanket that attaches magnetically to the cover. Overall, the claimed invention allows mothers to maintain eye contact with their babies and creates systems and methods for mothers to hold their babies close and snug to foster the close bond that occurs during nursing.

15 Claims, 6 Drawing Sheets

ARM-WORN COLLAPSIBLE NURSING COVER AND BLANKET

CROSS-REFERENCE TO RELATED APPLICATIONS

This invention is claiming reference to a provisional utility patent application which claims priority to US Provisional Patent Application Number 63/536,196 which was filed on Sep. 1, 2023, which is incorporated by reference in its entirety. Additionally related, is US Non-Provisional Design Patent Application Number 29/958,144. There are no References to Sequence Listing, Table or Computer Program.

CROSS REFERENCES: This invention is claiming reference to the following utility patent documents as references cited 11/681,301/U.S. Pat. No. 7,765,613B2 8/2010 Carr
13/541,620/U.S. Pat. No. 9,380,815B2 7/2016 Toro-Gerstein
12/968,842/U.S. Pat. No. 9,968,148B2 5/2018 Gibbons and Bonzer
18/198,455/U.S. Pat. No. 11,849,776B1 12/2023 Samuelson FEDERALLY SPONSORED RESEARCH OR DEVELOPMENT: None PARTIES TO A JOINT RESEARCH AGREEMENT: None INCORPORATION-BY-REFERENCE OF MATERIAL SUBMITTED ON A COMPACT DISC OR AS A TEXT FILE VIA THE OFFICE ELECTRONIC FILING SYSTEM: None STATEMENT REGARDING PRIOR DISCLOSURES BY THE INVENTOR OR A JOINT INVENTOR: None OATH/DECLARATION: See separately attached Form PTO/AIA/08 (11-15)

FIELD OF THE INVENTION

The present invention relates to various embodiments of nursing covers and has improved upon safety and use features. It is in the field of nursing canopies, and more specifically to such canopies that allow a nursing mother to discreetly breastfeed her infant. The present invention provides the features of a full coverage and a full view of the infant for the mother while nursing their infant.

CLASSIFICATIONS: A41D1/215 Nursing Garment, e.g. for breastfeeding

LANDSCAPE

Nursing
General Health & Medical Sciences
Pediatric Medicine
Health & Medical Sciences
Engineering & Computer Science
Textile Engineering
Public Health Environmental & Geological Engineering
Professional, Industrial, Or Sporting Protective Garments

BACKGROUND

Breastfeeding is a cherished and vital process that establishes a deep bond between mother and child. However, traditional nursing covers often present significant barriers that can disrupt this connection. Standard covers, usually draped over the mother and baby, create physical obstructions that make it difficult for the mother to maintain eye contact with her baby, monitor the latch, and ensure the baby's comfort. These covers can be cumbersome, restrictive, and often leave both mother and baby feeling disconnected. The lack of visibility and physical closeness can lead to a less intimate breastfeeding experience, ultimately detracting from the nurturing act of feeding.

The need for an arm-worn, collapsible nursing cover emerged from these challenges. This invention as shown and described herein, provides a solution that addresses the limitations of traditional designs while enhancing the breastfeeding experience. By being worn on the arm, this innovative cover allows mothers to maintain a clear view of their baby, ensuring that they can monitor the latch, positioning, and respond to their baby's needs in real time. The cover's design fosters continuous eye contact, which is crucial for bonding and emotional connection. Unlike traditional blanket covers that obscure the baby and create a physical barrier where most of the babies face and body are draped with a blanket like covering, an arm-worn cover ensures an unobstructed view that the mother and baby remain visually and emotionally connected throughout the feeding session.

In addition to maintaining eye contact and providing a clear view, the arm-worn collapsible nursing cover also offers temperature regulation, a significant advantage over traditional blanket-style covers. Standard covers can trap heat, leading to discomfort for both mother and baby, and could complicate breathing, especially in warmer climates, extremely hot temperatures, or during extended feeding sessions. By contrast, an arm-worn cover is designed to offer privacy without completely enveloping the baby, allowing for better airflow and helping to regulate temperature. This ensures that the baby remains comfortable and content while nursing, which is essential for both the effectiveness of the feeding and the overall experience for the mother and child.

Furthermore, the snug yet non-restrictive fit of this cover holds the baby close to the mother, supporting the physical closeness that is so important during breastfeeding. This design not only provides a secure and comforting environment for the baby but also allows the mother to maintain the natural positioning that is key to a successful latch and effective feeding. And finally, this invention solves the problem of visual distractions during nursing which can divert a baby's focus and make if difficult to maintain a peaceful nursing session and efficient feedings. The combination of eye contact, clear visibility, limiting distractions, temperature regulation, and physical closeness offered by the Arm-worn Collapsible Nursing Cover represents a significant improvement over traditional nursing covers. It provides a more comfortable, connected, private, and practical solution for breastfeeding mothers, meeting their needs in a way that traditional covers cannot. The open design allows for eye contact, unrestricted circulation, and direct accessibility which encourages a natural and fulfilling experience for both mother and baby.

BRIEF SUMMARY OF THE INVENTION

The Arm-worn Collapsible Nursing Cover and Blanket is engineered with a focus on functionality, convenience, and comfort for nursing mothers. One or more embodiments are provided for a system and methods for nursing a child comprising a nursing cover that is worn on the arm. The invention consists of a collapsible structure made of lightweight materials. The structure for the cover is formed by memory wire and foam and upheld by sewn fabric material sewn into the shape of an oval. A fabric rectangle is sewn to the front of the cover to serve as a front arm sleeve. An elastic band is sewn to the structure to serve a closure for when the cover is collapsed. And a magnet is affixed to the cover to allow for attachments to be added to the cover. The memory wire and foam form the shape of an oval and reside in a channel that surrounds the circumference of the oval cover.

When open and expanded, the tension from the memory wire is released and the cover springs open. The cover then pops up, or unfolds, and is fully expanded. Its functionality works by relying on a tensioned framework to allow it to expand and collapse and is executed by the mother moving their arm to the optimal angle and placement around the baby. Integral to the design of the cover are two side arm holes located on either side of the oval frame. These side arm holes are designed to fit over the mother's arm, hold in hand, or wrap around the baby's legs or feet. The side arm holes allow the cover to stay in place during nursing without the need for constant adjustment, and generally allow one hand to be free.

Once open and in use, the optional blanket attachment that is constructed of fabric with a magnet sewn in the corner can be attached to the cover and held together by magnetic force. The blanket is designed to work seamlessly with the nursing cover, providing additional privacy as needed. Constructed from soft fabric, the blanket is lightweight yet effective in offering protection from the elements or onlookers. A magnet is sewn into the edge of the blanket, enabling it to attach securely and is designed to be strong enough to hold the blanket in place during nursing, while still allowing for easy removal when the blanket is no longer required. The magnet's placement ensures that the blanket can be added or removed with minimal disruption to the baby.

To close the cover, the wire is collapsed into itself, causing the cover to form a small circle, and then held closed by the attached elastic band. Once collapsed, the small circle is portable and can be stored in a small space such as a standard sized purse or diaper bag. Other aspects of and advantages of the invention be demonstrated in the following descriptions and claims. Overall, the construction of the nursing cover and blanket is an improvement to traditional nursing covers and is combination of thoughtful design and engineering precision.

DETAILED DESCRIPTION OF THE INVENTION

The elements of the invention of an Arm-worn Collapsible Nursing Cover and Blanket as shown and described herein, consists of an oval shaped pop-up structure, constructed from a soft stretchy fabric which is supported by memory wire to create the structure. Around the circumference of the oval, foam tubing and memory wire are sewn into a channel and guided within to create the structured framework of the cover. On the back of the structure, a fabric rectangle is sewn to serve as a front arm sleeve.

On either side of the cover, two side arm holes are created and serve as openings that are used by the user's arms, hands, or the baby's feet to form the shape of the cover. Affixed to the top center is a magnet. And an elastic banding that creates a looped band that is used to close the cover is also sewn onto the cover. Separate from the cover, is a blanket that is sewn from fabric. And sewn onto the corners of the blanket are magnets. The cover and the blanket are crafted to attach to one another by their affixed magnets to provide optional additional coverage. The following in this section further details each of the drawings and figures of the Arm-worn Collapsible Nursing Cover and Blanket.

Figure 1:
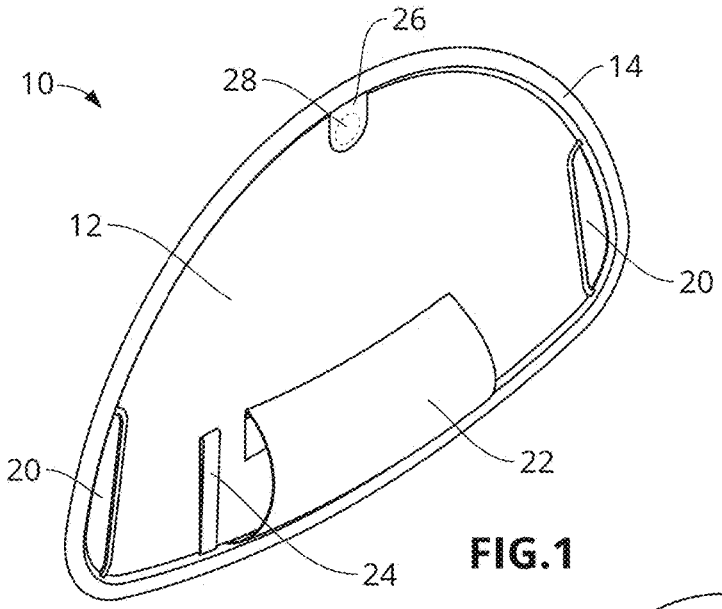
FIG. 1. is a pictorial illustration of the front perspective view of Arm-worn Nursing Cover.

FIG. 1 depicts the front perspective of the Arm-worn Nursing Cover and illustrates the overall design and key components. The nursing cover 10 serves as the main structure of the nursing cover, providing a secure and private environment for nursing. The cover is constructed from fabric 12, which is sewn around the edges of the structure 14 to provide a clean and finished look.

On either side of the nursing cover 10, side arm holes 20 are incorporated to allow the mother's arms to pass through comfortably, securing the cover in place during use. The front arm sleeve 22 is positioned at the front of the cover, designed to fit snugly over the mother's arm to maintain stability. The nursing cover 10 also includes a strap 24 that ensures the cover stays collapsed when closed.

Additionally, the magnet tab 26 is featured on the cover 10 and is designed to hold the magnet 28. This magnet 28 allows for the attachment of an optional blanket or additional cover, enhancing the cover's functionality by providing extra privacy or warmth when needed. The magnet 28 and its corresponding tab 26 are strategically placed to facilitate easy attachment and detachment of the blanket without disrupting the nursing process.

Figure 2:
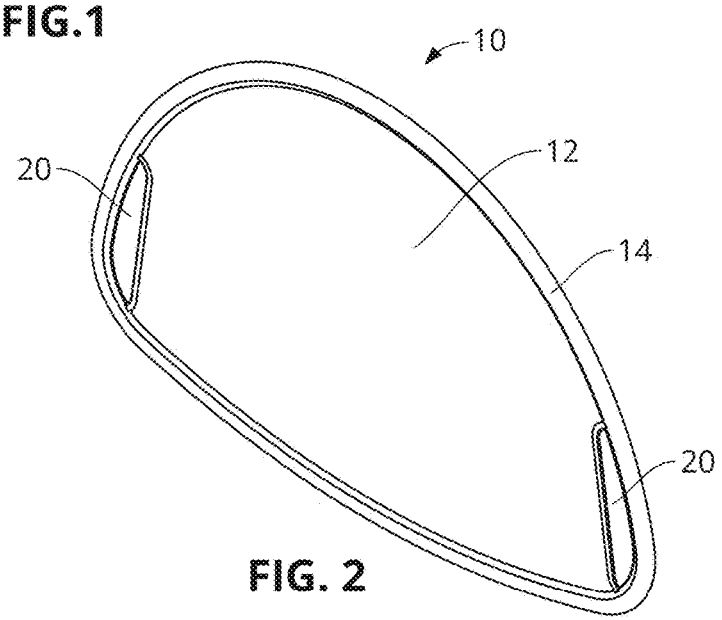
FIG. 2. is a pictorial illustration of the rear perspective view of the Arm-worn Nursing Cover.

FIG. 2 is the rear perspective view of the Arm-worn Nursing Cover, highlighting its structure and the key elements from the back. The privacy cover assembly 10 forms the main component of the nursing cover, providing an encompassing shield for nursing privacy. The cover is constructed from durable fabric 12, which is neatly finished with a fabric wrapped edge 14 along all sides, ensuring durability and a polished appearance.

From this rear perspective, the side arm holes 20 are clearly visible, showing where the mother's arms would pass through the cover. These side arm holes 20 are designed to provide comfort and ease of movement, while also securing the cover in place during nursing. The fabric 12 smoothly contours around the nursing cover 10, ensuring that the cover remains functional yet stylish from every angle.

Figure 3:
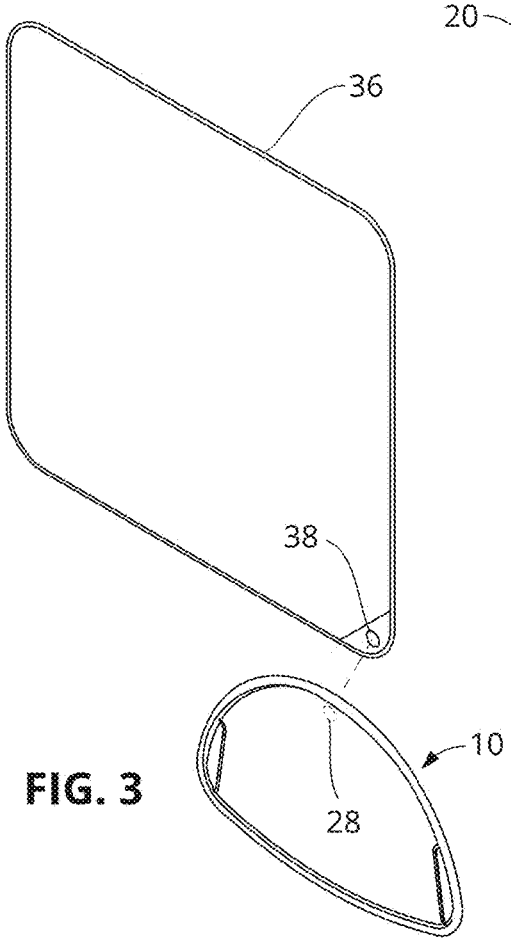
FIG. 3. is a pictorial illustration of the front view of the Arm-worn Nursing Cover.

FIG. 3 is the front view of the Arm-worn Nursing Cover and provides a clear illustration of its primary components and their arrangement. The expanded nursing cover 10 serves as the main structure of the nursing cover, designed to offer discreet coverage while nursing. Positioned on the front of the cover, the magnet 28 is strategically placed to securely attach the attachable blanket 36. The blanket 36 itself is designed to provide additional privacy, and it is equipped with a blanket magnet 38 that aligns with the magnet 28 on the privacy cover assembly 10, ensuring a secure and seamless connection.

Figure 4:
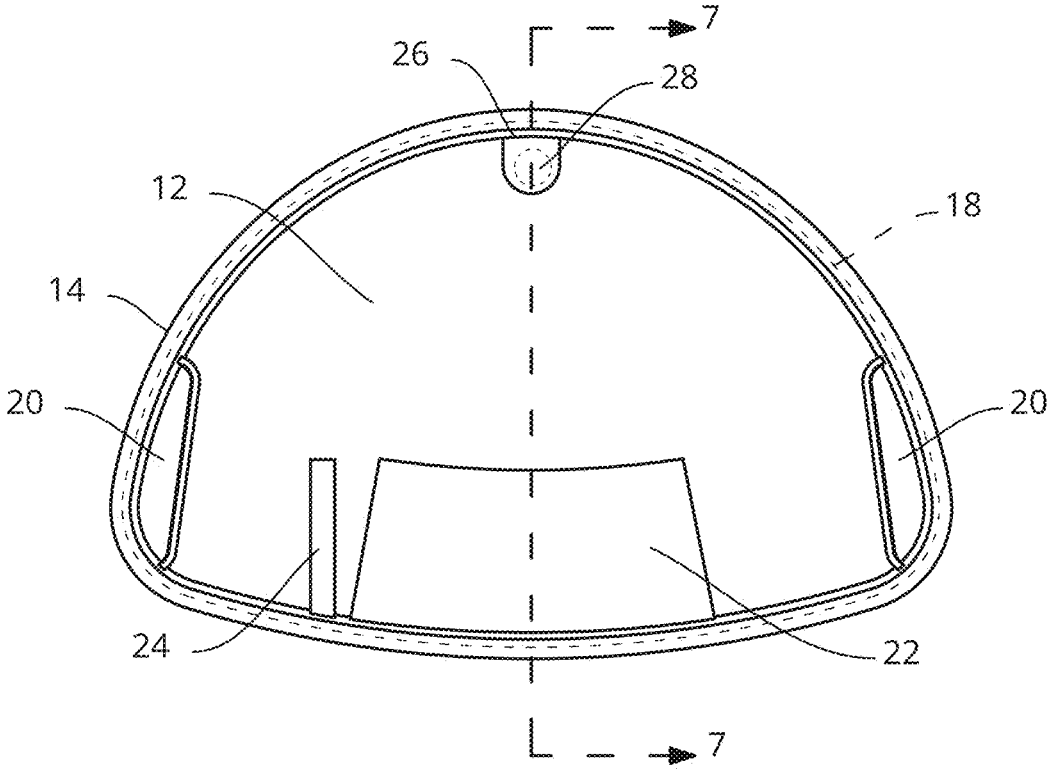
FIG. 4. is a pictorial illustration of an exploded view of the Arm-worn Nursing Cover and Blanket.

FIG. 4 is an exploded and open view of the Arm-worn Nursing Cover, revealing the internal structure and design elements. The fabric 12 forms the main body of the cover, with the fabric wrapped edge 14 providing a neat, finished appearance. Inside, the flexible wire core 18 allows the cover to collapse and expand as needed, offering ease of use and portability. The side arm holes 20 accommodate the user's arms, while the front arm sleeve 22 adds comfort and stability during wear. The strap 24 ensures a secure closure, and the magnet tab 26 along with the magnet 28 enable the optional blanket to be easily attached for additional coverage.

Figure 5:
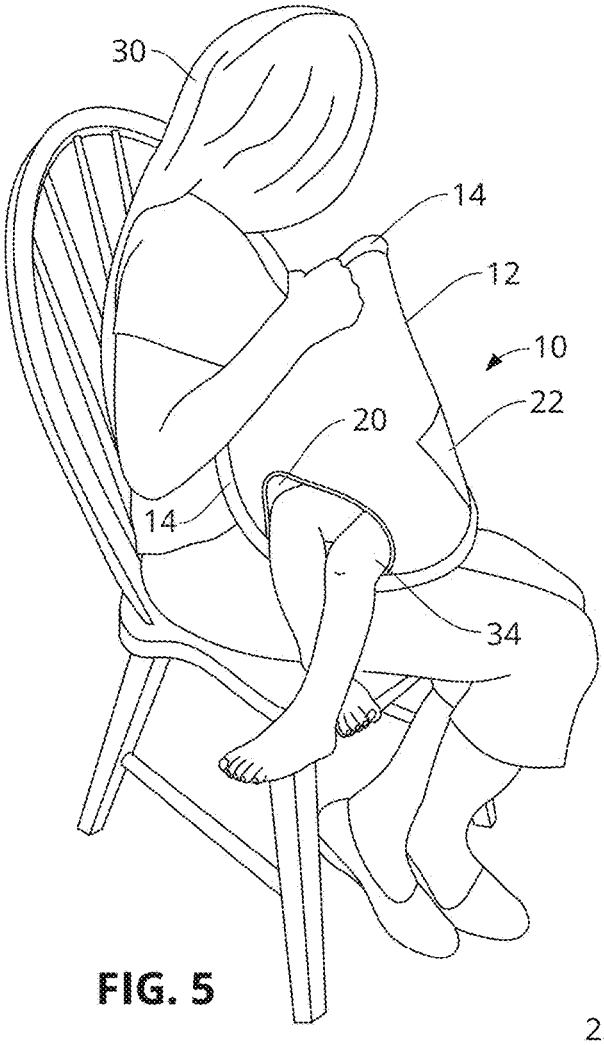
FIG. 5. is a pictorial illustration of a front view of the arm-worn nursing cover shown in use.

FIG. 5 is a front view illustration of the arm-worn nursing cover shown in use by a user, with an infant on their lap. The nursing cover 10 is in use by the user 30, and shown providing a secure and private nursing environment. The fabric 12 forms the body of the cover, while the fabric wrapped edge 14 adds a finished touch. The side arm holes 20 allow the infant's legs to comfortably extend through, ensuring a snug yet comfortable fit for the baby 34. The front arm sleeve 22 is shown, but not in use to show the versatility of use and wear of the cover. This functionality allows for discreet nursing while maintaining close contact between the mother and infant.

Figure 6:
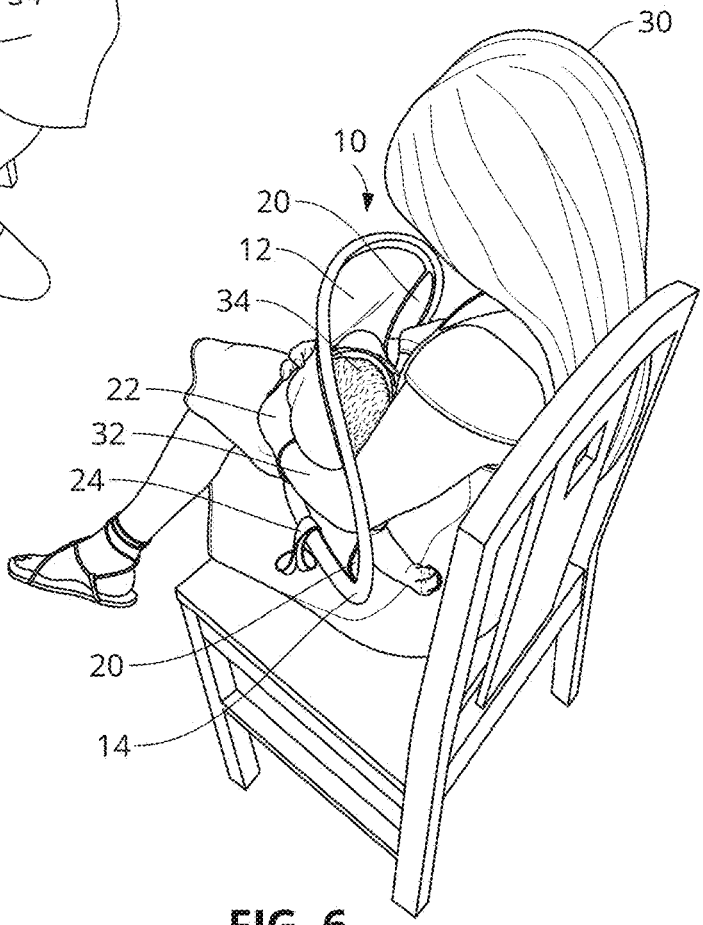
FIG. 6. is a pictorial illustration of a top rear perspective view of the Arm-worn Nursing Cover shown in use.

FIG. 6 is a top rear perspective view of the arm-worn nursing cover shown in use by the user and highlights the visibility it offers of the baby for the user. The nursing cover 10 is in use by the user 30, with the fabric 12 providing ample coverage while maintaining a soft and flexible fit. The fabric wrapped edge 14 adds a neat, finished look. The users' arms reach inside both side holes 20 to cradle the infant 34 comfortably. The front arm sleeve 22 is used to form the cradle and ensures the cover stays securely in place on the user's arm 32. Although the strap 24 is not in use in this view, but is included in the drawing, and is used to secure closure when in a closed state. The use of the cover allows the user to maintain clear, unobstructed eye contact with the baby, fostering connection during nursing.

Figure 7:
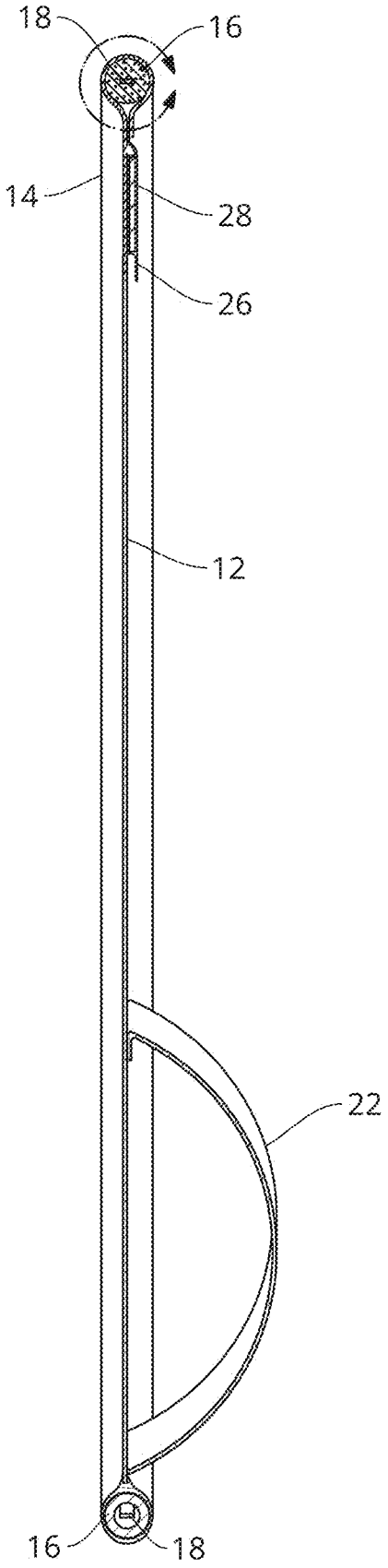
FIG. 7. is a pictorial illustration of a sectional view of the Arm-worn Nursing Cover.

FIG. 7 is a sectional side view of the Arm-worn Nursing Cover, provide a detailed look at its internal components. The fabric 12 forms the main body of the cover, offering softness and comfort. The fabric wrapped edge 14 ensures a smooth finish along the cover's perimeter. Within the cover, the foam ring 16 adds a layer of cushioning, enhancing comfort during use. The flexible wire core 18 is integrated into the design to provide structural support, allowing the cover to maintain its shape while being easily collapsible. The front arm sleeve 22 is shown, designed to hold the cover securely on the user's arm. The strap 24 provides additional stability when closed. The magnet tab 26 and the magnet 28 are included to attach an optional blanket, offering customizable coverage.

Figure 8:
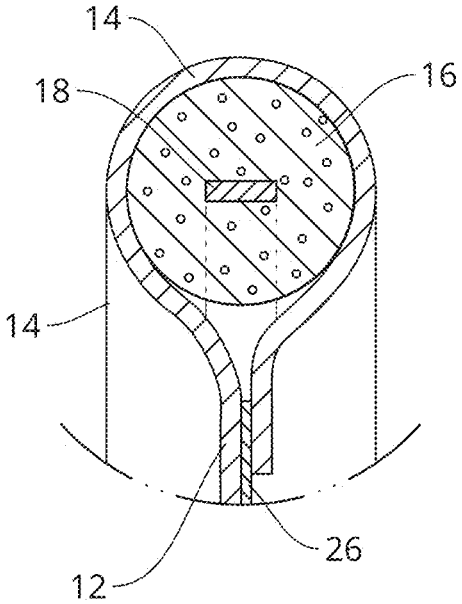
FIG. 8. is a pictorial illustration of a detailed section view of the Arm-worn Nursing Cover.

FIG. 8 is a detailed sectional view illustrating the internal components of the Arm-worn Nursing Cover. The fabric 12 makes up the main exterior surface, providing a soft and gentle layer for both mother and baby. The fabric wrapped edge 14 ensures a smooth and finished perimeter, preventing any rough edges. Beneath the fabric, the foam ring 16 is included to offer cushioning and comfort, making the cover more comfortable to wear for extended periods. The flexible wire core 18 is positioned within the foam ring, giving the cover its structure and flexibility, allowing it to easily pop open or collapse as needed. Finally, the magnet tab 26 is incorporated into the design, allowing for the secure attachment of optional accessories like a blanket, adding functionality and versatility to the nursing cover.

Figure 9:
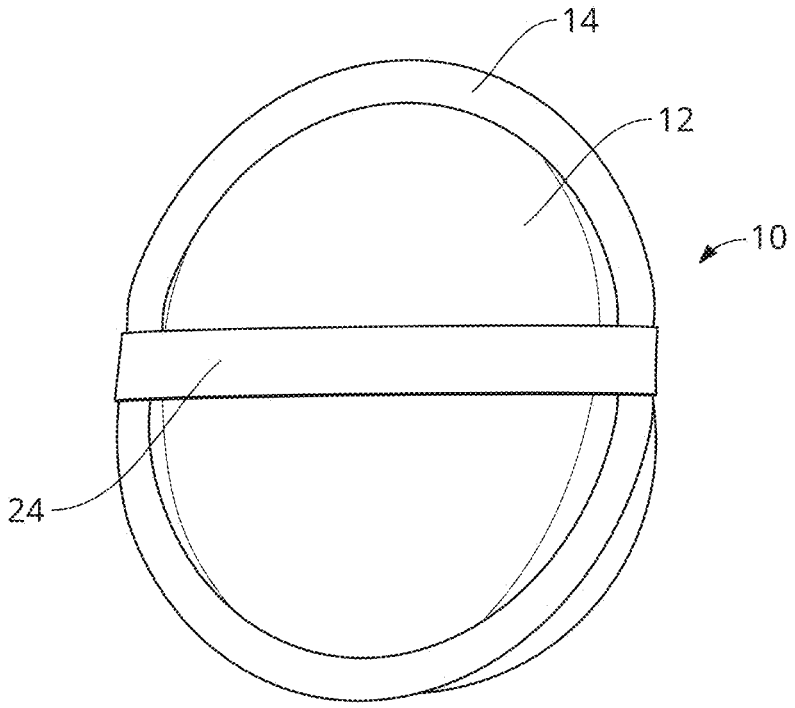
FIG. 9. is a pictorial illustration of a front view of the Arm-worn Nursing Cover, shown in a collapsed position for storage.

FIG. 9 is a front view of the Arm-worn Nursing Cover, depicted in its small circular collapsed position for storage. The nursing cover 10 is shown with the fabric 12 neatly collapsed and folded in on itself. The fabric wrapped edge 14 maintaining the integrity of the cover's perimeter. The strap 24 is securely fastened around the collapsed structure, ensuring the cover remains compact and easy to store in a bag or purse.

Figure 10:
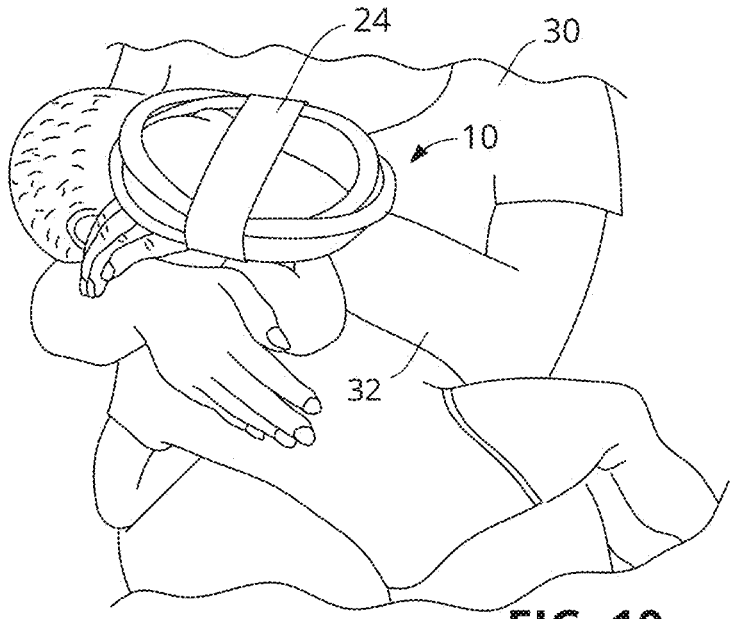
FIG. 10. is a pictorial illustration of a front view of the Arm-worn Nursing Cover in a collapsed position, shown being worn on the user's arm.

FIG. 10 is a front view of the Arm-worn Nursing Cover, displayed in its small circular collapsed position with the strap 24 holding in its closed position, and shown being worn on the user's wrist. The nursing cover 10 is compact, with the strap 24 securing it in place. The cover is in use on the user's arm 32 and is placed in front of the baby's face to offer a small discreet space for the infant to nurse.

Figure 11:
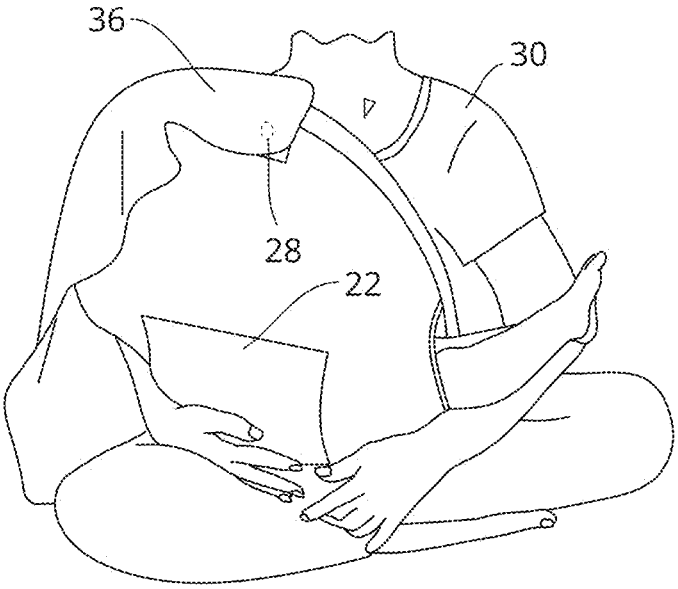
FIG. 11. is a pictorial illustration of a front view of the Arm-worn Nursing Cover and Blanket, shown in use with blanket.

FIG. 11 is a front view of the Arm-worn Nursing Cover, shown in use with the magnetic attachable blanket 36 secured to the cover by the magnet 28. The user's arm is not in the front arm sleeve 22, allowing for a more flexible arrangement, while the infant's feet are placed through the side arm holes 20, ensuring comfort, secure coverage, and a snug fit.

Figure 12:
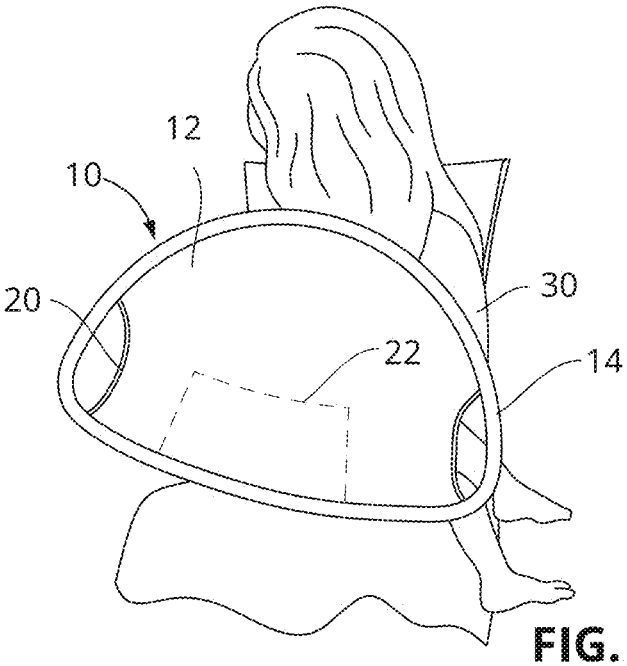
FIG. 12. is a pictorial illustration of the front view of the invention, shown in an alternate use.

FIG. 12 is a front view of the invention, depicted in use with the user's arm inside the front arm sleeve 22 and the cover turned backwards. In this configuration, the side arm holes 20 are not in use. The fabric 12 and fabric wrapped edge 14 maintain their shape, ensuring effective coverage. The nursing cover 10 is held upright as a barrier in front of the infant, providing a secure, private space for nursing.

What is claimed is:

1. A system for nursing an infant by a user, comprising:

an arm-worn nursing cover and blanket, comprising:

a sewn fabric structure in an oval or circular shape;

a memory wire is contained inside a channel around the circumference of the structure to create a structured yet flexible framework that expands when open and collapses to a smaller size when closed;

an open rectangular sleeve sewn on the fabric structure to serve as a front arm sleeve for the user wearing the cover;

a space for openings on the sides of the cover to serve as place for the arms of the user, or feet of the infant when using the cover;

a magnet affixed to the cover to allow for the integration of the optional blanket or other attachments to be affixed to the cover;

a blanket with magnets sewn onto the corners of the provides optional additional coverage over the users shoulder;

an elastic banding sewn on the cover to form a looped band that acts a closing mechanism to close and contain the cover when collapsed.

2. The system of claim 1, further comprising an attachable blanket wherein when the cover is worn on the user's arm, hand, or infant's feet, it creates an arched barrier for the user and infant from public view without touching, draping, blocking, or covering the baby's face or body.

3. The system of claim 1, wherein the cover is adjustable as it is worn on the users arm, hand, or infants feet the structured cover can be adjusted to form the optimal angle and placement around the infant.

4. The system of claim 1, wherein the cover and optional blanket are worn on the arm the structured cover forms an arched viewing space, the user has full visibility, and the infant can be placed in the ideal position to nurse with open viewing area with circulation and ventilation.

5. The system of claim 1, wherein with the cover and optional blanket are worn on the arm the structured cover additionally forms a sun block, sleep aid, or shield to keep others from accessing, touching, viewing, or breathing on the infant.

6. A method for using a cover for nursing a child comprising:

an arm-worn nursing cover and blanket, comprising:

a sewn fabric structure in an oval or circular shape;

a memory wire is contained inside a channel around the circumference of the structure to create a structured yet flexible framework that expands when open and collapses to a smaller size when closed;

an open rectangular sleeve sewn on the fabric structure to serve as a front arm sleeve for the user wearing the cover;

a space for openings on the sides of the cover to serve as place for the arm of the user, or feet of the infant when using the cover;

a magnet affixed to the cover to allow for the integration of the optional blanket or other attachments to be affixed to the cover;

a blanket with magnets sewn onto the corners of the provides optional additional coverage over the users shoulder;

an elastic banding sewn on the cover to form a looped band that acts a closing mechanism to close and contain the cover when collapsed.

7. The method as in claim 6, further comprising, wherein said cover is to be worn on the arm of a user, the user slides their arm through the arm opening, and through the front arm sleeve, and the user's hand grasps the end of the cover to bow the structure and create the arched shape that provides complete coverage with an unobstructed view of the infant.

8. The method as in claim 6, further comprising, wherein said cover is to be worn on the arm of a user, the user slides their arm through the arm opening, and the user slides the end of the cover around the infant's feet to bow the structure and create the arched shape that provides complete coverage with an unobstructed view of the infant.

9. The method as in claim 6, further comprising, wherein said cover is to be worn on the arm of a user, the user slides their arm through front arm sleeve, without the use of the side arm holes, and the user creates a flexible barrier that provides complete coverage with an unobstructed view of the infant.

10. The method as in claim 6, further comprising, wherein said cover is to be worn on both arms of a user, the user places both arms into the arm openings to bow the structure and create the arched shape and have free use of their hands inside of the space inside of the cover to provide complete coverage with an unobstructed view of the infant for the user.

11. The method as in claim 6, further comprising, wherein said cover is to be worn on the users hand or wrist, and in its collapsed state by keeping the elastic closure strap in place, and not expanding the cover to its full size in its open position, the user places the small collapsed circular shape in front of their chest to provide complete coverage with an unobstructed view of the infant for the user.

12. The method as in claim 6, further comprising, wherein said cover is to be worn on the arm of a user, the user slides their arm through the arm opening, and creates the bowed shape using any of the varied methods, and can affix the blanket to the structure by connecting the magnets placed in the cover and blanket together, and putting said over the users shoulder for additional cover that still provides an unobstructed view of the infant for the user.

13. The method as in claim 6, further comprising, wherein said cover is to be worn on the arm of a user, the user slides their arm through the arm opening, and creates the bowed shape using any of the varied methods, and can affix the blanket to the structure by connecting the magnets placed in the cover and blanket together, and putting said over the users shoulder for additional cover that still provides an unobstructed view of the infant for the user.

14. The method as in claim 6, further comprising, wherein said cover is to be worn on the arm of a user, the user slides their arm through the arm opening, and creates the bowed shape using any of the varied methods, and can utilize the cover as a sun block, changing area, sleep aid, or shield to keep others bystanders from accessing, touching, viewing, or accessing on the child.

15. The method as in claim 6, further comprising, wherein said cover is to be worn on the arm of a user, the user slides their arm through the arm opening, and creates the bowed shape using any of the varied methods and has the ability to adjust their arm to the optimal angle and placement around the infant to maximize coverage or their unobstructed view of the infant.

* * * * *